US008111830B2

(12) United States Patent
Moon et al.

(10) Patent No.: US 8,111,830 B2
(45) **Date of Patent: *Feb. 7, 2012**

(54) METHOD AND APPARATUS TO PROVIDE ACTIVE AUDIO MATRIX DECODING BASED ON THE POSITIONS OF SPEAKERS AND A LISTENER

(75) Inventors: Han-gil Moon, Seoul (KR); Manish Arora, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1449 days.

This patent is subject to a terminal disclaimer.

(21) Appl. No.: 11/641,080

(22) Filed: Dec. 19, 2006

(65) Prior Publication Data

US 2007/0140498 A1 Jun. 21, 2007

Related U.S. Application Data

(63) Continuation-in-part of application No. 11/535,234, filed on Sep. 26, 2006.

(30) Foreign Application Priority Data

Dec. 19, 2005 (KR) ..... 2005-125452
Nov. 10, 2006 (KR) ..... 10-2006-0111233

(51) Int. Cl.
*H04R 5/00* (2006.01)

(52) U.S. Cl. ..... 381/22; 381/20; 381/300; 381/307

(58) Field of Classification Search ..... 381/20, 381/22, 300, 307, 310, 58, 59
See application file for complete search history.

(56) References Cited

U.S. PATENT DOCUMENTS 5,930,370 A 7/1999 Ruzicka
6,072,878 A * 6/2000 Moorer ..... 381/18
(Continued)

FOREIGN PATENT DOCUMENTS

KR 1996-9554 7/1996
KR 1998-036958 8/1998
KR 10-206333 4/1999

*Primary Examiner* — Vivian Chin
*Assistant Examiner* — Friedrich W Fahnert
(74) *Attorney, Agent, or Firm* — Stanzione & Kim, LLP

(57) ABSTRACT

An active audio matrix decoding method and apparatus to generate multi-channel audio signals from a stereo channel audio signal. The method includes extracting characteristics of a plurality of speaker signals and angles of each of a plurality of multi-channel speakers from arbitrary signals reproduced by the multi-channel speakers, decoding a stereo signal into a plurality of multi-channel signals and correcting the decoded multi-channel signals based on the extracted characteristics of each of the plurality of speaker signals, extracting a power vector of each of the decoded multi-channel signals by multiplying a magnitude of each of the decoded multi-channel signals by an angle of each multi-channel speaker and extracting a vector of a virtual sound source existing between a plurality of channels based on the power vector of each of the decoded multi-channel signals, extracting a vector value of a dominant sound image by linearly combining the extracted vectors of the virtual sound sources and normalizing a position of each multi-channel speaker with respect to the vector value of the dominant sound image to obtain a normalized position value, and distributing a gain value to the position of each multi-channel speaker by comparing a magnitude of a combined decoded multi-channel signal with the magnitude of each of the decoded multi-channel signals.

47 Claims, 9 Drawing Sheets

U.S. PATENT DOCUMENTS

| | | | | |
|---|---|---|---|---|
| 6,694,027 | B1 | 2/2004 | Schneider | |
| 6,904,152 | B1 * | 6/2005 | Moorer | 381/18 |
| 6,970,567 | B1 * | 11/2005 | Gundry et al. | 381/22 |
| 7,394,903 | B2 * | 7/2008 | Herre et al. | 381/23 |
| 7,447,317 | B2 * | 11/2008 | Herre et al. | 381/23 |
| 7,606,373 | B2 * | 10/2009 | Moorer | 381/18 |
| 7,720,230 | B2 * | 5/2010 | Allamanche et al. | 381/22 |
| 7,761,304 | B2 * | 7/2010 | Faller | 704/502 |
| 2006/0045295 | A1 * | 3/2006 | Kim | 381/310 |
| 2006/0153408 | A1 * | 7/2006 | Faller et al. | 381/307 |
| 2007/0196964 | A1 * | 8/2007 | Kim et al. | 438/149 |
| 2008/0008327 | A1 * | 1/2008 | Ojala et al. | 381/20 |

* cited by examiner

METHOD AND APPARATUS TO PROVIDE ACTIVE AUDIO MATRIX DECODING BASED ON THE POSITIONS OF SPEAKERS AND A LISTENER

CROSS-REFERENCE TO RELATED APPLICATIONS

This is a continuation-in-part of U.S. patent application Ser. No. 11/535,234 entitled "METHOD AND APPARATUS TO PROVIDE ACTIVE AUDIO MATRIX DECODING" filed on Sep. 26, 2006 which claims the benefit of Korean Patent Application No. 10-2005-0125452, filed on Dec. 19, 2005, in the Korean Intellectual Property Office; and this application claims the benefit of Korean Patent Application No 2006-111233, filed on Nov. 10, 2006, in the Korean Intellectual Property Office, the disclosure of which are incorporated herein in its entirety by reference.

BACKGROUND OF THE INVENTION

1. Field of the Invention

The present general inventive concept relates to an audio reproducing system, and more particularly, to an active audio matrix decoding method based on positions of speakers and a listener, and an apparatus thereof.

2. Description of the Related Art

Generally, when movies are watched at home, ground wave broadcasting has been the main source of these movies in the past. However, video tapes, video discs, and satellite broadcasting have recently gained popularity and widespread use. Accordingly, original sound of movies can be enjoyed at home. In the video tapes, video discs, and satellite broadcastings which provide the original sound, a multi-channel audio signal is encoded into a 2-channel audio signal through matrix processing. Also, the 2-channel audio signal encoded through the matrix processing can be reproduced as a stereo signal. Furthermore, when a dedicated decoder is used, a 5-channel audio signal, including a front left (L) channel, a center (C) channel, a front right (R) channel, a left surround (Ls) channel, and a right surround (Rs) channel, is restored. In this 5-channel audio signal, the center channel signal plays a role in obtaining a correct localization that is for clearness of sound, and the surround channel signal(s) improve the actual feeling or perception of moving sound, environment sound, and echo sound.

A conventional matrix decoder generates a center channel and a surround channel by using a sum and a difference of two channel signals. An audio matrix in which matrix characteristics are not changed is known as a passive matrix decoder.

In each channel signal separated by the passive matrix decoder, when encoding is performed, other channel audio signals are scaled down and linearly combined together. Accordingly, the separation between the channels is low in the channel signals output through the conventional passive matrix decoder such that sound localization is not performed clearly. An active matrix decoder adaptively changes the matrix characteristics in order to improve separation among 2-channel matrix encoding signals.

U.S. Pat. No. 4,779,260 filed Feb. 6, 1986 entitled a "variable matrix decoder," and WO 02/19768 A 2 filed Aug. 31, 2000, entitled a "method and apparatus for audio matrix decoding" describe a conventional matrix decoder.

FIG. 1 illustrates the conventional matrix decoder. In the conventional matrix decoder, gain function units 110' and 116 clip an input signal in order to balance levels of a stereo signal (Rt, Lt). A passive matrix function unit 120' outputs a passive matrix signal from the stereo signal (R't, L't) output from the gain function units 110' and 116. The passive matrix function unit 120' also includes scaling function units 122 and 124, and combining function units 126 and 128. A variable gain signal generation unit 130' generates 6 control signals (gL, gR, gF, gB, gLB, gRB) in response to the passive matrix signal generated in the passive matrix function unit 120'. A matrix coefficient generation unit 132 generates 12 matrix coefficients in response to the 6 control signals generated in the variable gain signal generation unit 130'. An adaptive matrix function unit 114 generates output signals (L, C, R, L, Ls, Rs) in response to the input stereo signal (R't, L't) and the matrix coefficients generated in the matrix coefficient generation unit 132. The variable gain signal generation unit 130' monitors the level of each channel signal, and by calculating an optimum linear coefficient value with respect to the level of the monitored channel signal, reconstructs a multi-channel audio signal. The matrix coefficient generation unit 132 nonlinearly increases the level of a channel having a highest level.

However, the conventional matrix decoder illustrated in FIG. 1 does not consider positions of virtual sound sources generated in a multi-channel environment such that localization of a sound image cannot be performed accurately. Also, since it is difficult to express a positional change of a sound source moving in a virtual space, the capability of dynamically expressing a sound image is insufficient.

SUMMARY OF THE INVENTION

The present general inventive concept provides an active audio matrix decoding method and apparatus by which a level of each channel audio signal is tuned to an optimum based on positions of speakers and a listener.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept are achieved by providing an audio matrix decoding method, including extracting characteristics of a plurality of speaker signals and angles of each of a plurality of multi-channel speakers from arbitrary signals reproduced by the multi-channel speakers, decoding a stereo signal into a plurality of multi-channel signals and correcting the decoded multi-channel signals based on the extracted characteristics of each of the plurality of speaker signals, extracting a power vector of each of the decoded multi-channel signals by multiplying a magnitude of each of the decoded multi-channel signals by the angle of each multi-channel speaker and extracting a vector of a virtual sound source existing between a plurality of channels based on the power vector of each of the decoded multi-channel signals, extracting a vector value of a dominant sound image by linearly combining the extracted vectors of the virtual sound sources and normalizing a position of each multi-channel speaker with respect to the vector value of the dominant sound image to obtain a normalized position value, and distributing a gain value to the position of each multi-channel speaker by comparing a magnitude of a combined decoded multi-channel signal with the magnitude of each of the decoded multi-channel signals.

The foregoing and/or other aspects and utilities of the present general inventive concept may also be achieved by providing an audio matrix decoding apparatus including a speaker component extraction unit to extract characteristics of a plurality of speaker signals and angles of each of a plurality of multi-channel speakers from arbitrary signals reproduced by the multi-channel speakers, a passive matrix decoder unit to decode a stereo signal into multi-channel signals, a signal correction unit to correct the multi-channel signals decoded by the passive matrix decoder unit based on the characteristics of each of the plurality of speaker signals extracted by the speaker component extraction unit, a virtual sound source power vector estimation unit to extract a vector of a virtual sound source existing between a plurality of channels by combining power vectors of the multi-channel signals obtained by multiplying a magnitude of each of the multi-channel signals corrected by the signal correction unit by the angles of the corresponding multi-channel speakers, a global vector extraction unit to extract a global vector indicating a position and magnitude of a dominant sound image by linearly combining the virtual sound source vectors estimated by the virtual sound source power vector estimation unit, a channel selection unit to normalize a position of each of the multi-channel speakers with respect to the position of the dominant sound image estimated by the global vector extraction unit to obtain a normalized position value, and a channel power distribution unit to distribute the magnitude of each of the multi-channel signals according to a ratio of the magnitude of each individual multi-channel signal to a magnitude of a combined decoded multi-channel signal including all the decoded multi-channel signals.

The audio matrix decoding apparatus may further include a channel extending unit to generate sound sources for a left back channel and a right back channel using a vector projection method, and to readjust levels of power of a surround left channel signal and a surround right channel signal in consideration of a left back channel signal and a right back channel signal, and a channel power increasing unit to recalculate power of each of the multi-channel signals and to redistribute the recalculated power to each of the multi-channel signals.

The foregoing and/or other aspects and utilities of the present general inventive concept may also be achieved by providing an audio matrix decoding method including extracting characteristics of a plurality of speaker signals and angles of each of a plurality of multi-channel speakers from arbitrary signals reproduced by the multi-channel speakers, decoding a stereo signal into a plurality of multi-channel signals, correcting the decoded multi-channel signals based on the extracted characteristics of each of the plurality of speaker signals, and adjusting gain values of each of the decoded multi-channel signals by comparing magnitudes of the decoded multi-channel signals with a magnitude of a combined decoded multi-channel signal.

The magnitude of the combined decoded multi-channel signal may include the magnitudes of all the decoded multi-channel signals.

The method may further include extracting a power vector of the decoded multi-channel signals by multiplying a magnitude of each of the decoded multi-channel signals by the angle of each multi-channel speaker and extracting a vector of a virtual sound source existing between a plurality of channels based on the power vector of each of the decoded multi-channel signals, and extracting a vector value of a dominant sound image by linearly combining the extracted vectors of the virtual sound sources and normalizing a position of each multi-channel speaker with respect to the vector value of the dominant sound image.

The adjusting of the gain values may include comparing the magnitude of the combined decoded multi-channel signal with the magnitude of each individual multi-channel signal and adjusting the magnitude of each multi-channel signal according to a ratio of the magnitude of each individual multi-channel signal to the magnitude of the combined decoded multi-channel signal, and multiplying the adjusted magnitude of the multi-channel signal by the normalized position value.

The method may further include generating sound sources for a left back channel and a right back channel using a vector projection method, readjusting levels of power of a surround left channel signal and a surround right channel signal in consideration of a left back channel signal and a right back channel signal, recalculating power of each of the multi-channel signals, and redistributing the recalculated power to each of the multi-channel signals.

The foregoing and/or other aspects and utilities of the present general inventive concept may also be achieved by providing an audio matrix decoding apparatus including a speaker component extraction unit to extract characteristics of a plurality of speaker signals and angles of each of a plurality of multi-channel speakers from arbitrary signals reproduced by the multi-channel speakers, a passive matrix decoder unit to decode a stereo signal into multi-channel signals, a signal correction unit to correct the multi-channel signals decoded by the passive matrix decoder unit based on the characteristics of each of the plurality of speaker signals extracted by the speaker component extraction unit, and a channel power distribution unit to adjust gain values of each of the decoded multi-channel signals by comparing magnitudes of the decoded multi-channel signals with a magnitude of a combined decoded multi-channel signal.

The foregoing and/or other aspects and utilities of the present general inventive concept may also be achieved by providing an audio matrix decoding method including extracting angles of each of a plurality of multi-channel speakers from arbitrary signals reproduced by the multi-channel speakers, and restoring a sound image distorted due to changes in the angles of the multi-channel speakers to an intended sound image.

The foregoing and/or other aspects and utilities of the present general inventive concept may also be achieved by providing an audio matrix decoding apparatus including an audio matrix decoding apparatus including a speaker component extraction unit to extract angles of each of a plurality of multi-channel speakers from arbitrary signals reproduced by the multi-channel speakers, and a signal correction unit to restore a sound image distorted due to changes in the angles of the multi-channel speakers to an intended sound image.

The foregoing and/or other aspects and utilities of the present general inventive concept may also be achieved by providing an audio matrix decoding method of generating a multi-channel audio signal from a stereo-channel audio signal, the method including decoding the stereo-channel audio signal into a multi-channel signal, extracting a power vector of each channel signal by multiplying a magnitude of each decoded channel signal by positions of a plurality of channel speakers, extracting a vector of a virtual sound source existing between each channel by linearly combining power vector values of respective decoded channels, extracting a vector value of a dominant sound image by linearly combining the vectors of the extracted virtual sound sources and normalizing the position of each channel speaker with respect to the vector value of the dominant sound image, and distributing a gain value to the position or each channel speaker by comparing the magnitude of an entire decoded channel signal including all the decoded channel signals with the magnitude of each individual channel signal.

The extracting of the power vector may include calculating power value by squaring each decoded channel signal, and calculating the power vector of each channel signal by multiplying a position vector of each channel speaker in the form of polar coordinates by the calculated power value.

The extracting of the vector of the virtual sound source may include adding the power vector value of a predetermined channel to the power vector value of a channel adjacent to the predetermined channel.

The calculating of the normalized position values may include calculating the vector of the dominant sound image by linearly combining the extracted vectors of the virtual sound sources, and calculating a normalized position value of each channel speaker by subtracting the position of the dominant sound image from the position of the channel speaker.

The distributing of the gain value may include comparing the magnitude of an entire decoded channel signal including all the decoded channel signals with the magnitude of each individual channel signal and adjusting the magnitude of each channel signal according to a ratio of the magnitude of each individual channel signal to the magnitude of the entire decoded channel signal, and multiplying the magnitude of the signal adjusted in each channel by the position value of each normalized channel.

The foregoing and/or other aspects and utilities of the present general inventive concept may also be achieved by providing an audio matrix decoding method, including passively decoding two channel signals into multi-channel signals, and adjusting characteristics of the multi-channel signals based on corresponding power vectors of the decoded multi-channel signals, positions of channel speakers corresponding to the multi-channel signals, and characteristics of virtual sound source vectors derived from the power vectors.

The adjusting of the characteristics of the multi-channel signals may include determining the power vectors of the decoded multi-channel signals by determining an energy component of each of the multi-channel signals that corresponds to an angular direction in which the corresponding channel speakers are arranged.

The adjusting of the characteristics of the multi-channel signals may include determining the virtual sound source vectors by combining the power vectors of adjacent pairs of the multi-channel signals.

The adjusting of the characteristics of the multi-channel signals may include determining a global power vector by combining each of the virtual sound source vectors and normalizing the positions of each of the channel speakers based on a comparison of the global power vector and the positions of each of the channel speakers.

The adjusting of the characteristics of the multi-channel signals may include determining the normalized positions of the channel speakers by subtracting an angular position of the global power vector from each of the positions of the channel speakers.

The adjusting of the characteristics of the multi-channel signals may further include comparing a magnitude of each of the individual multi-channel signals with a magnitude of a combination of the multi-channel signals to determine corresponding gain adjustment amounts, and adjusting the gains of the multi-channel signals by the corresponding gain adjustment amounts, and repositioning the gain adjusted multi-channel signals based on the normalized positions of the corresponding channel speakers.

The foregoing and/or other aspects and utilities of the present general inventive concept may also be achieved by providing an audio matrix decoding apparatus, including a passive decoding unit to decode two channel signals into multi-channel signals, and an active decoding unit to adjust characteristics of the multi-channel signals based on corresponding power vectors of the decoded multi-channel signals, positions of channel speakers corresponding to the multi-channel signals, and characteristics of virtual sound source vectors derived from the power vectors.

The active decoding unit may determine the power vectors of the decoded multi-channel signals by determining an energy component of each of the multi-channel signals that corresponds to an angular direction in which the corresponding channel speakers are arranged.

The active decoding unit may determine the virtual sound source vectors by combining the power vectors of adjacent pairs of the multi-channel signals.

The active decoding unit may determine a global power vector by combining each of the virtual sound source vectors and normalizing the positions of each of the channel speakers based on a comparison of the global power vector and the positions of each of the channel speakers.

The active decoding unit may determine the normalized positions of the channel speakers by subtracting an angular position of the global power vector from each of the positions of the channel speakers.

The active decoding unit may compare a magnitude of each of the individual multi-channel signals with a magnitude of a combination of the multi-channel signals to determine corresponding gain adjustment amounts, adjusts the gains of the multi-channel signals by the corresponding gain adjustment amounts, and repositions the gain adjusted multi-channel signals based on the normalized positions of the corresponding channel speakers.

The active decoding unit may extract the power vectors of each channel signal by multiplying a magnitude of each decoded channel signal by positions of the channel speakers, extract the virtual sound source vector existing between each channel by linearly combining power vector values of respective decoded channels, extract a vector value of a dominant sound image by linearly combining the vectors of the extracted virtual sound sources and normalizing the position of each channel speaker with respect to the vector value of the dominant sound image, and distribute a gain value to each channel position by comparing the magnitude of an entire decoded channel signal with the magnitude of each channel signal.

The foregoing and/or other aspects and utilities of the present general inventive concept may also be achieved by providing an audio matrix decoding apparatus to generate a multi-channel audio signal from a stereo-channel audio signal, the apparatus including a passive decoder unit to decode the stereo-channel audio signal into a multi-channel signal through linear combination of channels, and an active decoder unit to extract a power vector of each channel signal by multiplying a magnitude of each channel signal decoded by the passive decoder unit by positions of a plurality of channel speakers, to extract a vector of a virtual sound source existing between each channel from power vector values of respective channels, to extract a global vector indicating a position and magnitude of a dominant sound image by linearly combining the virtual sound source vectors, to normalize the position of each channel speaker with respect to the position of the dominant sound image, and to distribute the magnitude of each channel signal according to a ratio of the magnitude of each individual channel signal to a magnitude of an entire decoded channel signal including all the decoded channel signals.

The foregoing and/or other aspects and utilities of the present general inventive concept may also be achieved by providing an audio matrix decoding apparatus to generate a multi-channel audio signal from a stereo-channel audio signal, the apparatus including a passive matrix decoder unit to decode the stereo-channel audio signal into a multi-channel signal through linear combination of channels, a channel power vector extraction unit to extract a power vector of each channel signal by multiplying a magnitude of each channel signal decoded in the passive matrix decoder unit by positions of a plurality of channel speakers, a virtual sound source power vector estimation unit to extract a vector of a virtual sound source existing between each channel from power vector values of respective channels extracted from the channel power vector extraction unit, a global vector extraction unit to extract a global vector indicating a position and magnitude of a dominant sound image by linearly combining the virtual sound source vectors estimated in the virtual sound source power vector estimation unit, a channel selection unit to normalize the position of each channel speaker with respect to the position of the dominant sound image estimated in the global vector extraction unit, and a channel power distribution unit to distribute the magnitude of each channel signal according to a ratio of the magnitude of each individual channel signal to a magnitude of an entire decoded channel signal including all of the decoded channel signals.

The channel power vector extraction unit may include a squaring unit to calculate each power value by squaring each decoded multi-channel signal, and a multiplication unit to calculate the power vector of each channel by multiplying the magnitude of each channel signal calculated by the squaring unit by the position value of the corresponding speaker in the form of polar coordinates.

The virtual sound source power vector estimation unit may include an adder to add the vector value of a selected channel signal to the vector of a channel adjacent to the predetermined channel.

The channel selection unit may include a subtracter to subtract the position of the dominant sound image extracted by the global vector extraction unit from the position value of a selected channel speaker.

The channel power distribution unit may include a multiplier to output a redistributed signal of each channel by multiplying a disposition function having the position values of the normalized channels as parameters by a gain adjusting function having the magnitude values of the decoded channel signals as parameters.

The gain adjusting function may increase the magnitude of a selected channel signal if the ratio of the magnitude of the decoded selected channel signal to the magnitude of the entire decoded channel signal is equal to or greater than a predetermine level, and decrease the magnitude of the selected channel signal if the ratio is less than the predetermined level.

The foregoing and/or other aspects and utilities of the present general inventive concept may also be achieved by providing a computer readable medium containing executable code to perform an active audio matrix decoding, the medium including executable code to perform a passive decoding operation on two channel signals to determine multi-channel signals, and executable code to redistribute the decoded multi-channel signals according to positions of corresponding channel speakers and characteristics of the multi-channel signals.

BRIEF DESCRIPTION OF THE DRAWINGS

These and/or other aspects of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
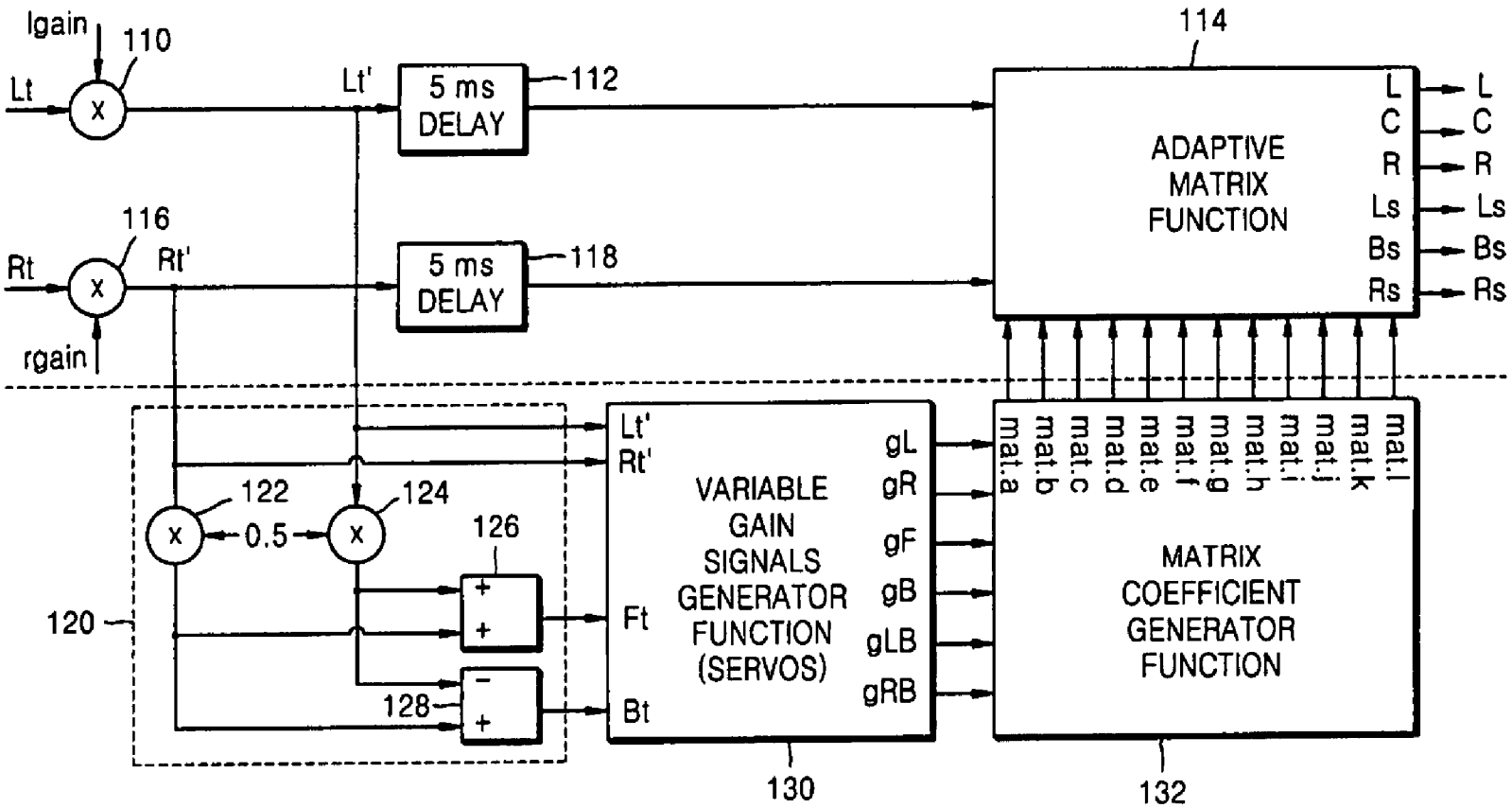
FIG. 1 (RELATED ART)
FIG. 1 illustrates a conventional matrix decoder.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
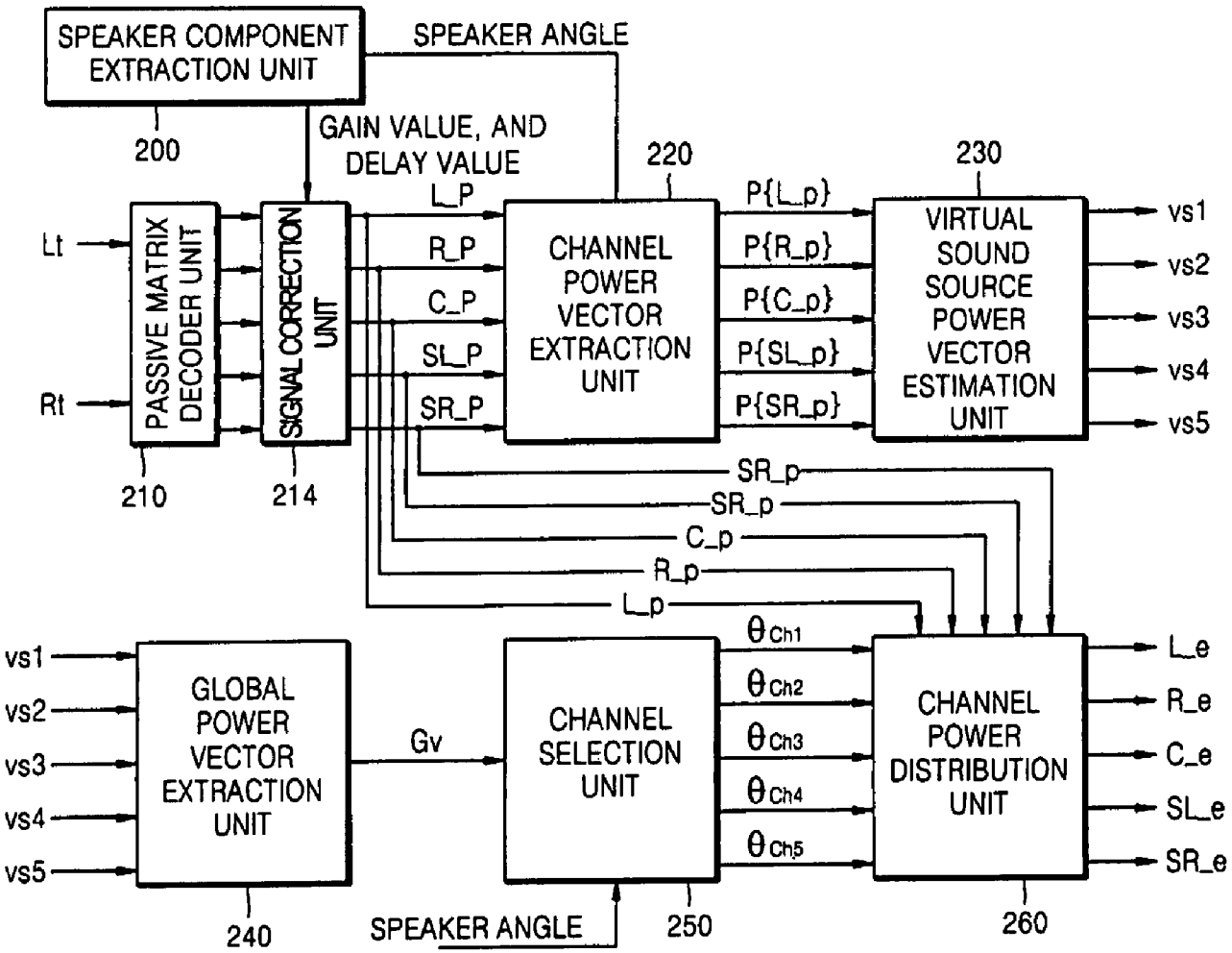
FIG. 2 is a block diagram illustrating an active audio matrix decoding apparatus according to an embodiment of the present general inventive concept.

FIG. 2 is a block diagram illustrating an active audio matrix decoding apparatus according to an embodiment of the present general inventive concept.

The active audio matrix decoding apparatus of FIG. 2 includes a speaker component extraction unit 200, a passive matrix decoder unit 210, a signal correction unit 214, a channel power vector extraction unit 220, a virtual sound source power vector estimation unit 230, a global power vector extraction unit 240, a channel selection unit 250, and a channel power distribution unit 260.

First, a signal providing apparatus (not illustrated) receives a signal from a video tape, a video disc, or satellite broadcasting, and reproduces a video signal and an audio signal. The audio signal is a matrix-encoded two-channel stereo signal. The video signal is then provided to a monitor (not illustrated).

The speaker component extraction unit 200 extracts characteristics of a plurality of speaker signals and angles of a plurality of multi-channel speakers (hereinafter referred to as "speakers") by applying appropriate signal processing and beam forming technologies to arbitrary signals reproduced by the speakers. In other words, the speaker component extraction unit 200 extracts a gain value from a level of the arbitrary signals reproduced from each speaker, extracts a signal delay from a point in time when the arbitrary signals are output from each speaker to a point in time when the arbitrary signals are input to a pair of microphones as delay values corresponding to each speaker, and extracts an angle of each speaker by detecting a difference in paths taken by the arbitrary signals received by the pair of microphones.

The passive matrix decoder unit 210 decodes the matrix-encoded stereo signal (Lt, Rt) into a left channel signal (L_p), a center channel signal (C_p), a right channel signal (R_p), a left surround channel signal (SL_p), and a right surround channel signal (SR_p) through linear combination.

The signal correction unit 214 generates corrected signals by applying the gain value and the delay value of each speaker extracted by the speaker component extraction unit 200 to each channel signal decoded by the passive matrix decoding unit 210. Thus, the signal correction unit 214 restores a sound image distorted due to a change in the position of a speaker to an intended sound image. In another embodiment, the signal correction unit 214 can use a gain value and a delay value which are predetermined by a user, instead of the gain value and the delay value extracted by the speaker component extraction unit 200.

The channel power vector extraction unit 220 extracts 5 channel power vectors (P{L_p}, P{C_p}, P{R_p}, P{SL_p}, P{SR_p}) by multiplying a magnitude of each of the channel signals (L_p, C_p, R_p, SL_p, SR_p) corrected by the signal correction unit 214 by an angle of the corresponding speaker extracted by the speaker component extraction unit 200. In another embodiment, the channel power vector extraction unit 220 can use an angle of each speaker predetermined by the user, instead of the angle of each speaker extracted by the speaker component extraction unit 200.

From the power vectors of the respective channels (P{L_p}, P{C_p}, P{R_p}, P{L_p}, P{SR_p}), the virtual sound source vector estimation unit 230 calculates virtual sound source vectors (vs1, vs2, vs3, vs4, vs5) existing between each channel.

The global power vector extraction unit 240 extracts a global power vector (Gv) through linear combination of the virtual sound source vectors (vs1, vs2, vs3, vs4, vs5) calculated by the virtual sound source power vector estimation unit 230 and identifies a position and a magnitude of a sound image that is the most dominant from among an entire sound image. The global power vector (Gv) may be a sum of the virtual sound source vectors (vs1, vs2, vs3, vs4, vs5).

The channel selection unit 250 normalizes a speaker position of each channel relative to the position of the dominant sound image corresponding to the global power vector (Gv) extracted by the global vector extraction unit 240. That is, in order to improve the gain of a signal, the channel selection unit 250 selects channels to be output.

The channel power distribution unit 260 adjusts a signal gain of each channel by comparing the magnitude of each channel signal (L_p, C_p, R_p, SL_p, SR_p) decoded in the passive matrix decoder unit 210 with the magnitude of a combined channel signal ($Lp^2+R_p^2+C_p^2+SL_p^2+SR_p^2$) including all the decoded channel signals, and redistributes the adjusted signal gain to the position of each channel normalized by the channel selection unit 250. Accordingly, the channel power distribution unit 260 outputs signals in which gains are redistributed for each channel (L_e, R_e, C_e, SL_e, SR_e). The passive matrix decoder unit 210 may be a passive decoding unit while the channel power vector extraction unit 220, the virtual sound source power vector estimation unit 230, the global power vector extraction unit 240, the channel selection unit 250, and the channel power distribution unit 260 may collectively be an active decoding unit.

Figure 3A:
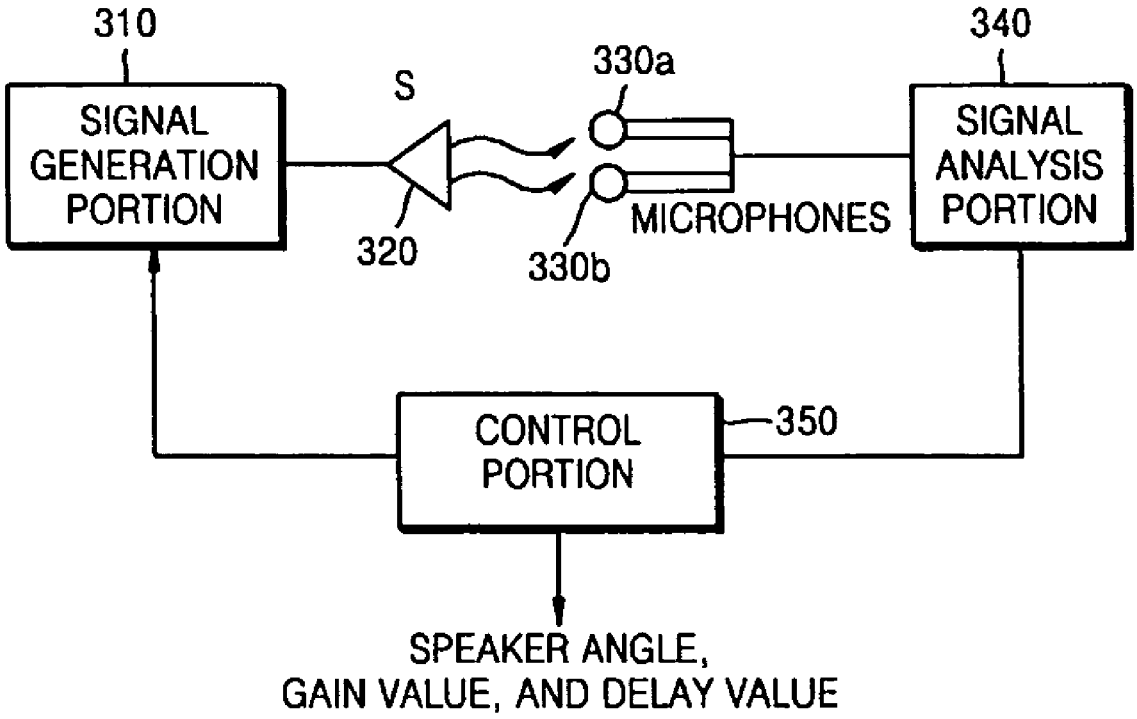
FIG. 3A illustrates a speaker component extraction unit of the active audio matrix decoding apparatus of FIG. 2.

FIG. 3A is a detailed block diagram of the speaker component extraction unit 200 of FIG. 2.

A signal generation portion 310 generates a digital broadband signal and generates a test signal using the digital broadband signal. The test signal can be, for example, a white noise signal or an impulse noise signal.

A speaker 320, which may represent one of the plurality of multi-channel speakers mentioned above, reproduces the signal generated by the signal generation unit 310 as sound.

A pair of microphones 330*a* and 330*b* convert the sound reproduced by the speaker 320 to electrical signals.

A signal analysis portion 340 analyzes characteristics of the signals received by the pair of microphones 330*a* and 330*b*.

A control portion 350 extracts a gain value from levels of the signals analyzed by the signal analysis portion 340, extracts a delay value from a point in time when an arbitrary signal is generated by the signal generation portion 310 to a point in time when signals are received by the pair of microphones 330*a* and 330*b*, and extracts an angle of the speaker 320 by detecting a difference in paths taken by the signals received by the pair of microphones 330*a* and 330*b*.

Figure 3B:
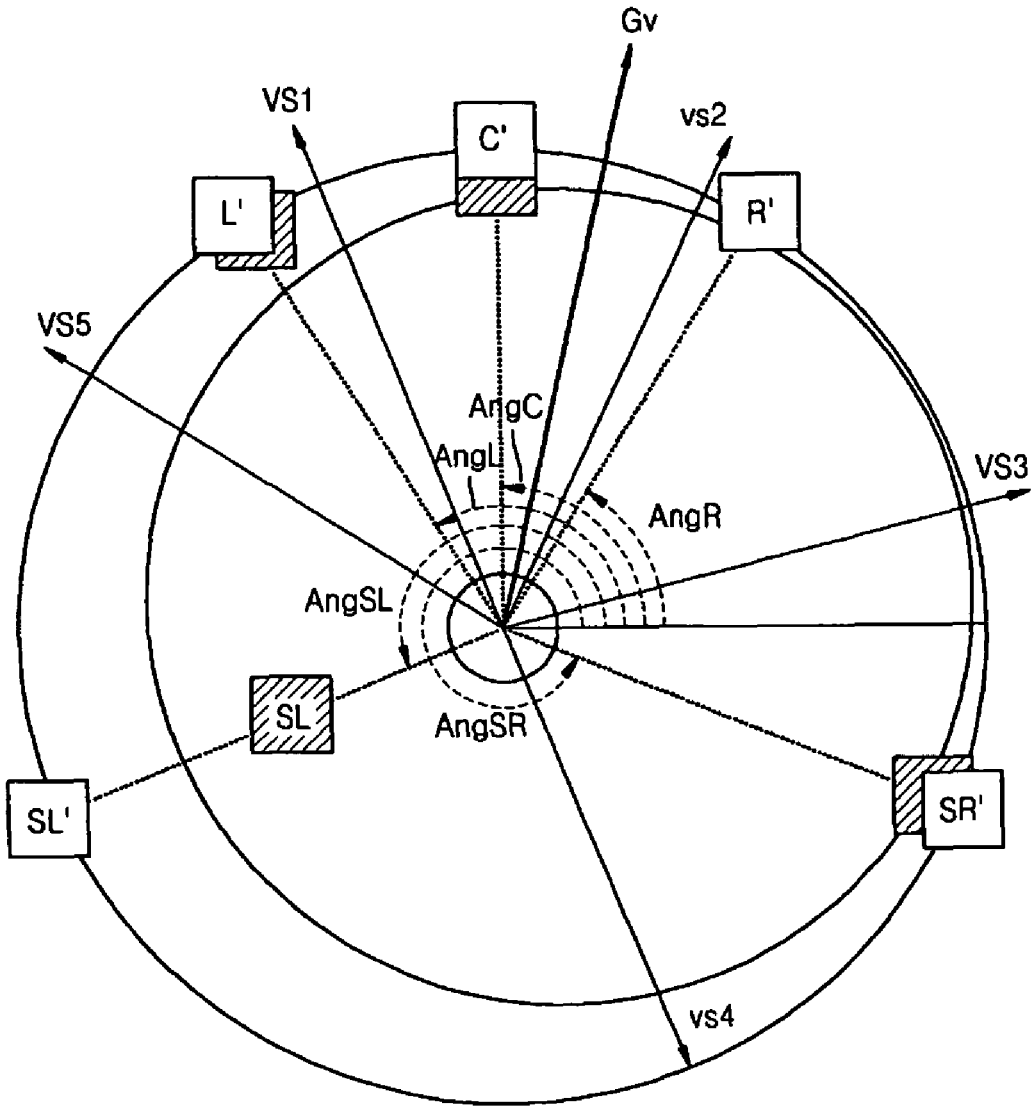
FIG. 3B illustrates redistribution of energy with respect to positions of each channel speaker and virtual sound sources according to an embodiment of the present general inventive concept.

FIG. 3B illustrates redistribution of energy of each channel (e.g., by adjusting the gain) with respect to the positions of each channel speaker and the virtual sound sources according to an embodiment of the present general inventive concept.

FIG. 3B illustrates virtual positions of speakers after the gain value and the delay value for each channel signal have been corrected by the signal correction unit 214. In other words, the layout of the reproducing speakers L, C, R, SL, and SR (hashed rectangles) can vary according to the position of a listener. Accordingly, the signal correction unit 214 restores a sound image distorted due to a change in the position of the listener to an original, intended sound image by correcting channel signals. Referring to FIG. 3B, virtual positions L', C', R', SL', and SR' of the speakers are closer to and around the position of the listener due to the correction of the gain value and the delay value.

In addition, the angles of left, center, right, left surround, and right surround channel speakers (L, C, R, SL, SR) are expressed as AngL, AngC, AngR, AngSL, and AngSR, respectively. Also, the virtual sound source vectors (vs1, vs2, vs3, vs4, vs5) exist between each channel speaker. The global power vector (Gv) indicates the position of the sound image most dominant from among all the sound images (i.e., an entire sound image). In other words, the global power vector (Gv) may be a sum of all the virtual sound source vectors (vs1, vs2, vs3, vs4, vs5). Accordingly, a signal level adjusted by a gain adjusting function is redistributed to the position of each channel speaker normalized based on the global power vector (Gv).

Figure 4:
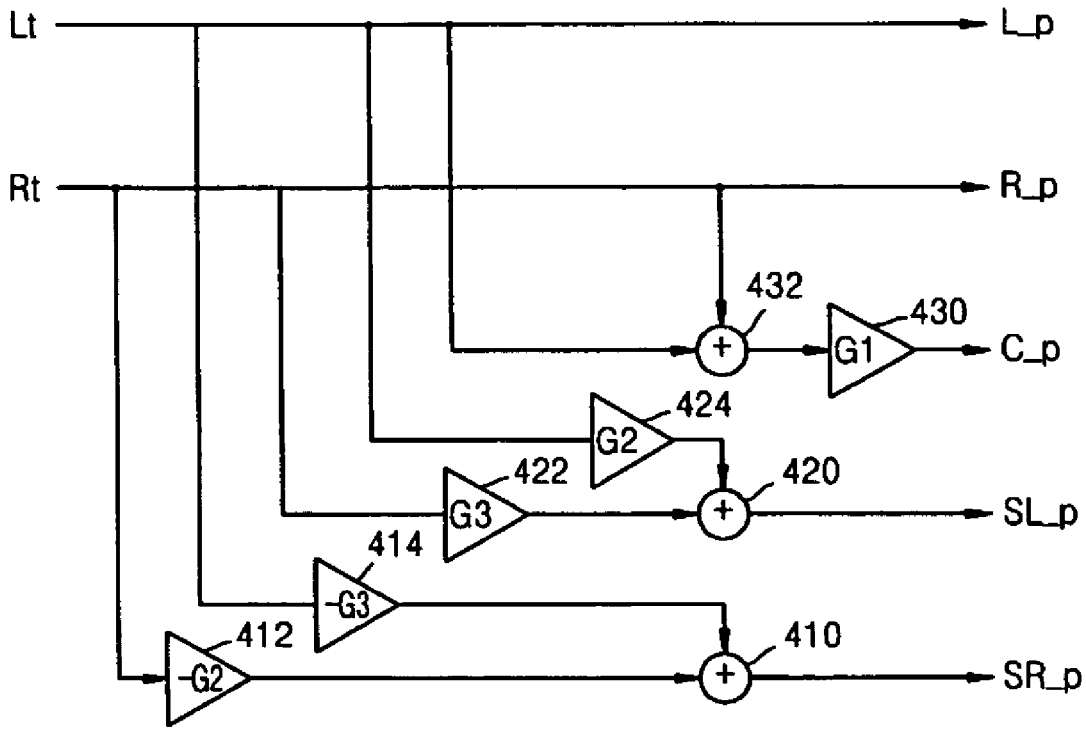
FIG. 4 illustrates a passive matrix decoder unit of the active audio matrix decoding apparatus of FIG. 2, according to an embodiment of the present general inventive concept.

FIG. 4 illustrates the passive matrix decoder unit 210 of FIG. 2 according to an embodiment of the present general inventive concept. The matrix-encoded stereo signal (Lt, Rt) is decoded into 5 channel audio signals (L_p, C_p, R_p, SL_p, SR_p), including the left, center, right, left surround, and right surround channel audio signals through linear combination using multipliers 412, 414, 422, 424, 432, and 430, and adders 410, 420, and 432. For example, L_p=Lt, R_p=Rt, C_p=0.7*(Lt+Rt), SL_p=−0.866Lt+0.5Rt, SR_p=−0.5Lt+0.866Rt.

Figure 5:
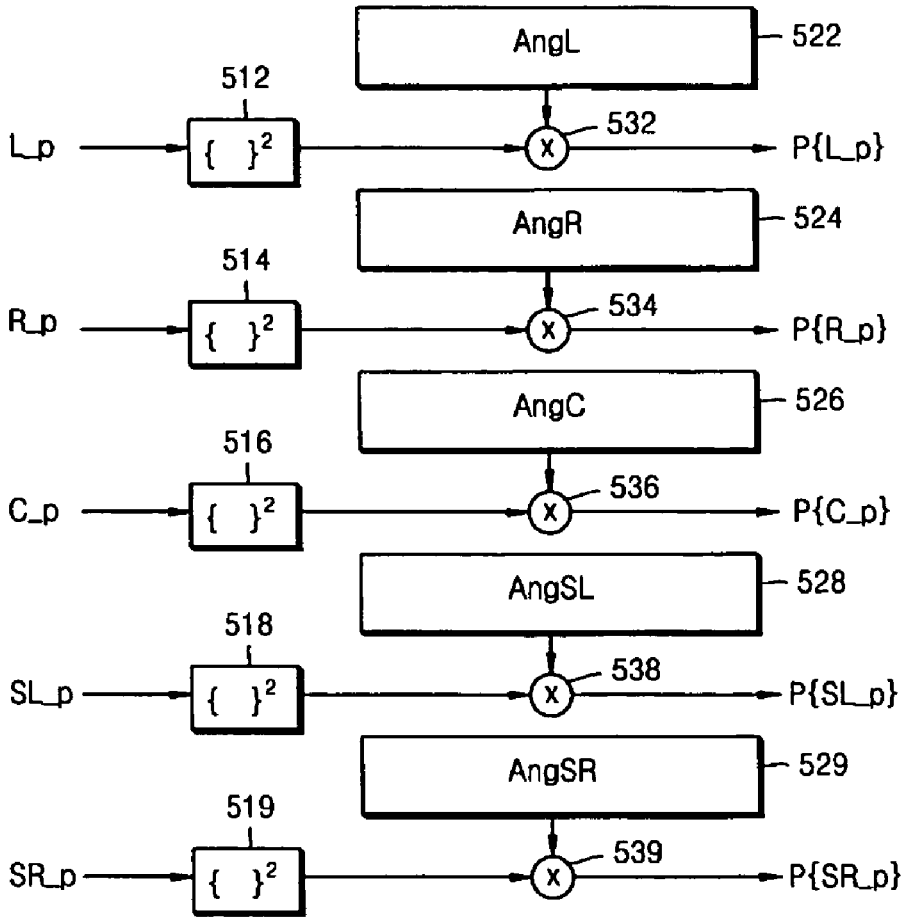
FIG. 5 illustrates a channel power vector extraction unit of the active audio matrix decoding apparatus of FIG. 2, according to an embodiment of the present general inventive concept.

FIG. 5 illustrates the channel power vector extraction unit 220 of FIG. 2 according to an embodiment of the present general inventive concept.

Referring to FIG. 5, first through fifth squaring units 512, 514, 516, 518, and 519 square the left, center, right, left surround, and right surround channel signals (L_p, C_p, R_p, SL_p, SR_p), respectively, decoded by the passive matrix decoder unit 210 and calculate respective power values.

A first multiplier 532 extracts the power vector (P{L_p}) of the left channel by multiplying the power value of the left channel signal L_p calculated by the first squaring unit 512 by an extracted angle AngL (for example, 120 degrees) of the left channel speaker.

A second multiplier 534 extracts the power vector (P{R_p}) of the right channel by multiplying the power value of the right channel signal R_p calculated by the second squaring unit 514 by an extracted angle AngR (for example, 60 degrees) of the right channel speaker.

A third multiplier 536 extracts the power vector (P{C_p}) of the center channel by multiplying the power value of the center channel signal C_p calculated by the third squaring unit 516 by an extracted angle AngC (for example, 90 degrees) of the center channel speaker.

A fourth multiplier 538 extracts the power vector (P{SL_p}) of the left surround channel by multiplying the power value of the left surround channel signal SL_p calculated by the fourth squaring unit 518 by an extracted angle AngSL (for example, 200 degrees) of the left surround channel speaker.

A fifth multiplier 539 extracts the power vector (P{SR_p}) of the right surround channel by multiplying the power value of the right surround channel signal SR_p calculated by the fifth squaring unit 519 by an extracted angle AngSR (for example, 340 degrees) of the right surround channel speaker. The channel power vector extraction unit 220 determines energy components of the decoded channel signals that correspond to a direction or position in which the corresponding channel speaker is arranged. For example, the channel power vector extraction unit 220 determines the energy component of the right surround channel SR_p that corresponds to the direction or position of $17\pi/9$ (340 degrees from center) as the power vector (P{SR_p}) of the right surround channel.

Figure 6:
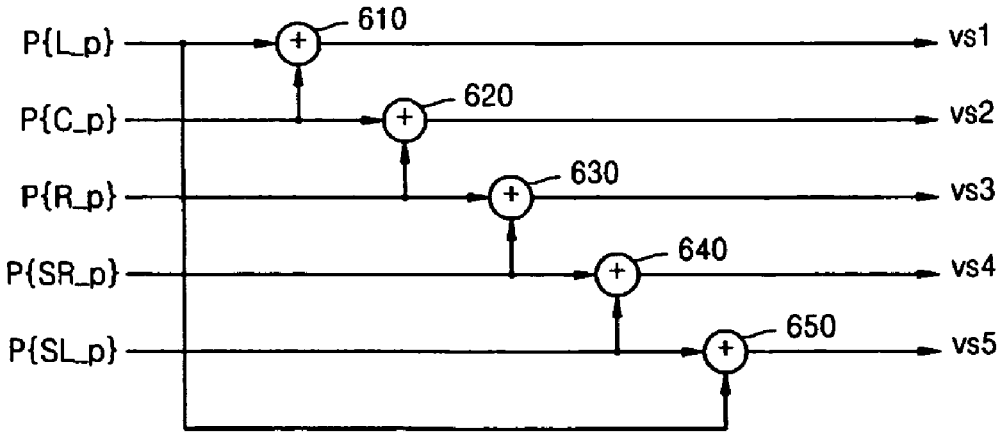
FIG. 6 illustrates a virtual sound source power vector estimation unit of the active audio matrix decoding apparatus of FIG. 2, according to an embodiment of the present general inventive concept.

FIG. 6 illustrates the virtual sound source power vector estimation unit 230 of FIG. 2 according to an embodiment of the present general inventive concept.

A first adder 610 extracts a first virtual sound source vector value (vs1) by adding the power vector (P{L_p}) of the left channel and the power vector (P{C_p}) of the center channel.

A second adder 620 extracts a second virtual sound source vector value (vs2) by adding the power vector (P{C_p}) of the center channel and the power vector (P{R_p}) of the right channel.

A third adder 630 extracts a third virtual sound source vector value (vs3) by adding the power vector (P{R_p}) of the right channel and the power vector (P{SR_p}) of the right surround channel.

A fourth adder 640 extracts a fourth virtual sound source vector value (vs4) by adding the power vector (P{SR_p}) of the right surround channel and the power vector (P{SL_p}) of the left surround channel.

A fifth adder 650 extracts a fifth virtual sound source vector value (vs5) by adding the power vector (P{SL_p}) of the left surround channel and the power vector (P{L_p}) of the left channel.

Figure 7:
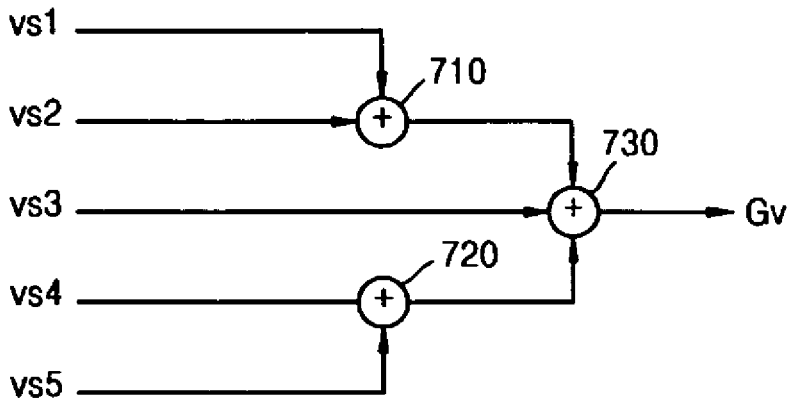
FIG. 7 illustrates a global power vector extraction unit of the active audio matrix decoding apparatus of FIG. 2, according to an embodiment of the present general inventive concept.

FIG. 7 illustrates the global power vector extraction unit 240 of FIG. 2 according to an embodiment of the present general inventive concept.

The first through fifth virtual sound source vector values (vs1, vs2, vs3, vs4, vs5) are linearly combined by adders 710, 720 and 730 to generate the global vector (Gv). This global vector (Gv) indicates the position and the magnitude of the sound image that is the most dominant from among all the sound images.

Figure 8:
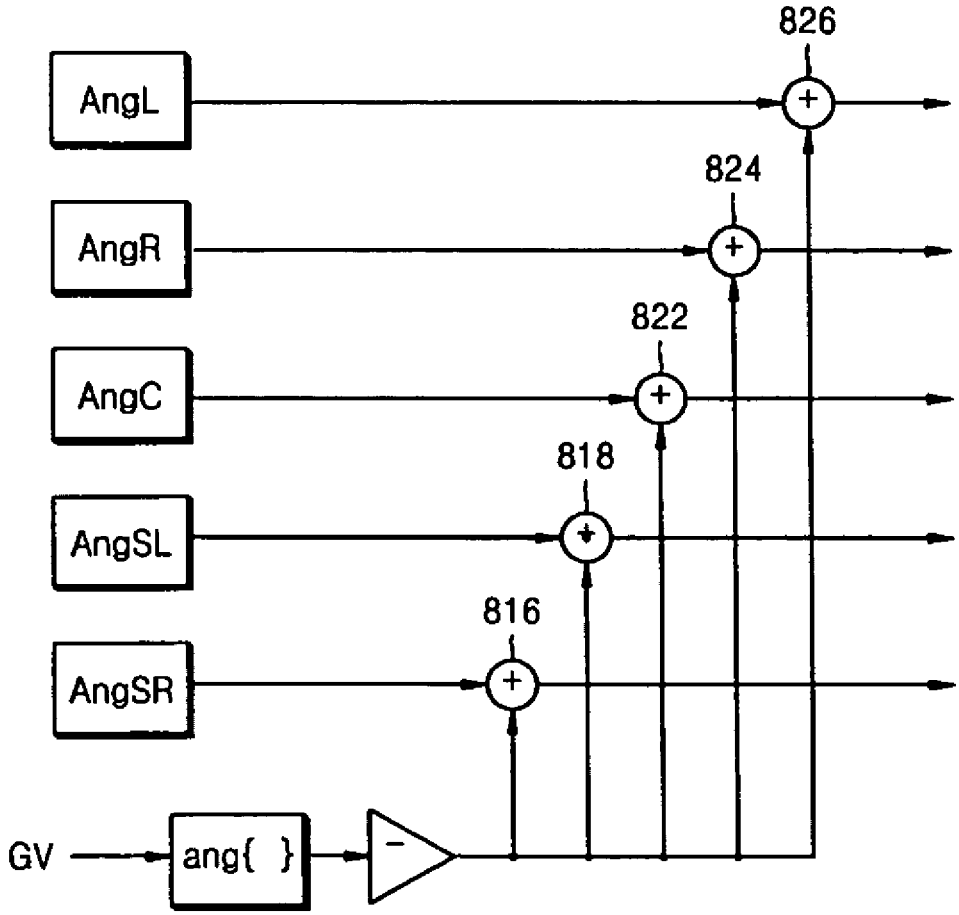
FIG. 8 illustrates a channel selection unit of the active audio matrix decoding apparatus of FIG. 2, according to an embodiment of the present general inventive concept.

FIG. 8 illustrates the channel selection unit 250 of FIG. 2 according to an embodiment of the present general inventive concept.

A first subtracter 826 obtains a speaker position ($\theta_{ch1}$) of the normalized left channel by subtracting the position value of the global vector (Gv) from the angle AngR of the left channel speaker.

A second subtracter 824 obtains a speaker position ($\theta_{ch2}$) of the normalized right channel by subtracting the position value of the global vector (Gv) from the angle AngL of the right channel speaker.

A third subtracter 822 obtains a speaker position ($\theta_{ch3}$) of the normalized center channel by subtracting the position value of the global vector (Gv) from the angle AngC of the center channel speaker.

A fourth subtracter 818 obtains a speaker position ($\theta_{ch4}$) of the normalized left surround channel by subtracting the position value of the global vector (Gv) from the angle AngRS of the left surround channel speaker.

A fifth subtracter 816 obtains a speaker position ($\theta_{ch5}$) of the normalized right surround channel by subtracting the position value of the global vector (Gv) from the angle AngSL of the right surround channel speaker.

Figure 9:
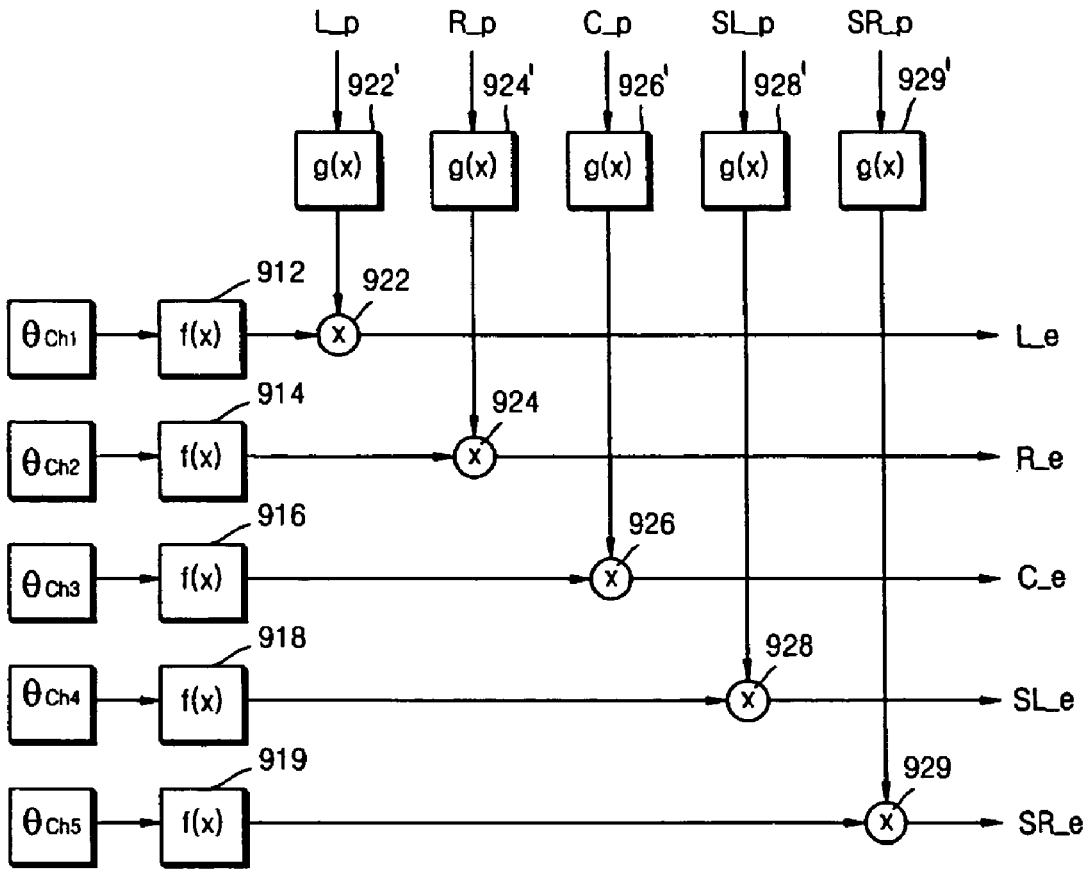
FIG. 9 illustrates a channel power distribution unit of the active audio matrix decoding apparatus of FIG. 2, according to an embodiment of the present general inventive concept.

FIG. 9 illustrates the channel power distribution unit 260 of FIG. 2 according to an embodiment of the present general inventive concept.

First through fifth multipliers 922, 924, 926, 928, and 929 output redistributed channel signals (L_e, R_e, C_e, SL_e, SR_e), respectively, by multiplying disposition functions f(x) 912, 914, 916, 918, and 919 having the position values ($\theta_{ch1}$, $\theta_{ch2}$, $\theta_{ch3}$, $\theta_{ch4}$, $\theta_{ch5}$) of the normalized channels as parameters by gain adjusting functions g(x) 922', 924', 926', 928', and 929', respectively, having the magnitude values (L_p, R_p, C_p, SL_p, SR_p) of the decoded channel signals as parameters.

The gain adjusting function g(x) compares the magnitude of the combined decoded channel signal (i.e., all the decoded channel signals combined) with the magnitude of each individual channel signal, and adjusts the magnitude of each individual channel signal according to a ratio of the magnitude of each channel signal to the magnitude of the combined channel signal. For example, if the magnitude of the right channel signal (R_p) is equal to or greater than 20% of the magnitude of the combined channel signal ($L_p^2+R_p^2+C_p^2+SL_p^2+SR_p^2$), the magnitude (R_p) of the right channel signal is increased in proportion to a logarithmic function.

Figure 10:
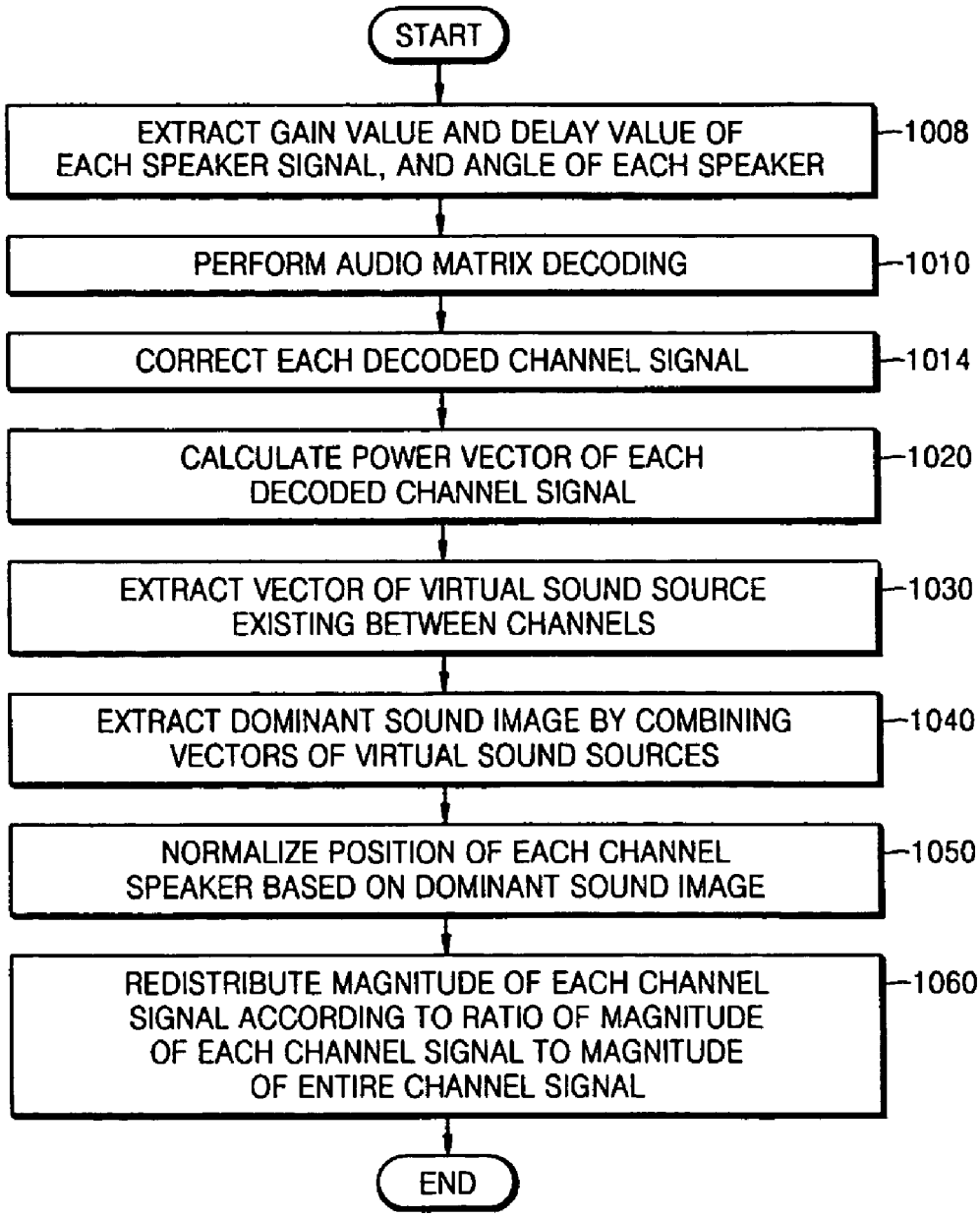
FIG. 10 is a flowchart illustrating a method of audio matrix decoding according to an embodiment of the present general inventive concept.

FIG. 10 is a flowchart illustrating a method of audio matrix decoding according to an embodiment of the present general inventive concept.

A gain value and a delay value of each speaker signal and an angle of each speaker are extracted from arbitrary signals reproduced through multi-channel speakers in operation 1008.

In operation 1010, a matrix-encoded stereo signal is decoded into a multi-channel signal using a passive matrix decoding algorithm In operation 1014, corrected channel signals are generated by applying the extracted gain value and delay value to each decoded channel signal.

A power vector of each decoded channel signal is calculated by multiplying a magnitude of each corrected channel signal by the extracted angle of each multi-channel speaker in operation 1020.

A vector of a virtual sound source existing between each channel is extracted in operation 1030 by linearly combining the power vector of each decoded channel together with an adjacent decoded channel signal.

A global vector indicating a position of a dominant sound image is calculated and a position of each channel speaker is normalized with respect to the position of the dominant sound image in operation 1050 by linearly combining the extracted vectors of the virtual sound sources.

The magnitude of the combined decoded channel signal is compared with the magnitude of each channel signal such that the magnitude of each channel signal is adjusted according to a ratio of the magnitude of each channel signal to the magnitude of the combined channel signal. Accordingly, the magnitude of the signal (energy) adjusted in each channel is redistributed to the position of each channel speaker in operation 1060.

The present general inventive concept is not limited to the above-described embodiments, and changes may be made to the embodiments by one of ordinary skill in the art within the scope of the general inventive concept. In another embodiment, sound sources for 5 channels can be extended to sound sources for 7 channels. In other words, a 7-channel matrix decoder may include a channel extending unit (not illustrated) and a channel power increasing unit (not illustrated). The channel extending unit may generate sound sources for a left back channel and a right back channel from 5-channel sound sources using a vector projection method, and may readjust the levels of power of a surround left channel signal and a surround right channel signal in consideration of new left back channel and right back channel signals.

For example, the channel extending unit may obtain levels of power of left back and right back channels located at the positions of 40 degrees and 100 degrees, respectively, with respect to left and right surround channels SL and SR among 5 channels using a vector projection method.

In addition, the channel power increasing unit may select a level of power by which to increase each channel according to positions of all sound sources, and may redistribute the power to each channel corresponding to the positions of all sound sources using a nonlinear function. In other words, the channel power increasing unit may select a level of power to be increased for each channel according to the positions of all the sound sources of 7 channels. The channel power increasing unit may determine a level of power to be increased according to the position of each channel using a function, recalculate the power for each channel using a nonlinear function g(x), and redistribute the power to all the channels.

The present general inventive concept can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion.

According to the embodiments of the present general inventive concept as described above, a level of each channel signal can be tuned optimally based on a position of a virtual sound source corresponding to positions of each speaker and a listener. Accordingly, limits of a conventional matrix decoder, i.e., a low separation due to high correction necessarily occurring between channels can be solved psycho acoustically. In addition, a sound image distorted due to a change in the position of the listener can be restored to an originally intended sound image by signal correction.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An audio matrix decoding method comprising:

extracting characteristics of a plurality of speaker signals and angles of each of a plurality of multi-channel speakers from arbitrary signals reproduced by the multi-channel speakers;

decoding a stereo signal into a plurality of multi-channel signals and correcting the decoded multi-channel signals based on the extracted characteristics of each of the plurality of speaker signals;

extracting a power vector of each of the decoded multi-channel signals by multiplying a magnitude of each of the decoded multi-channel signals by the angle of each multi-channel speaker and extracting a vector of a virtual sound source existing between a plurality of channels based on the power vector of each of the decoded multi-channel signals;

extracting a vector value of a dominant sound image by linearly combining the extracted vectors of the virtual sound sources and normalizing a position of each multi-channel speaker with respect to the vector value of the dominant sound image to obtain a normalized position value; and distributing a gain value to the position of each multi-channel speaker by comparing a magnitude of a combined decoded multi-channel signal with the magnitude of each of the decoded multi-channel signals.

2. The audio matrix decoding method of claim 1, wherein the extracting of the characteristics of each of the plurality of speaker signals comprises:

extracting gain values from levels of the arbitrary signals reproduced from the multi-channel speakers; and extracting signal delay values from a point in time when the arbitrary signals are output from the multi-channel speakers to a point in time when the arbitrary signals are input to a plurality of microphones.

3. The audio matrix decoding method of claim 1, wherein the extracting of the angle of each multi-channel speaker is performed by detecting a difference in paths taken by the arbitrary signals received by a pair of microphones through each of the multi-channel speakers.

4. The audio matrix decoding method of claim 1, wherein the correcting of the decoded multi-channel signals is performed by applying a gain value and a signal delay value extracted from each of the plurality of speaker signals to the decoded multi-channel signals.

5. The audio matrix decoding method of claim 1, wherein the correcting of the decoded multi-channel signals is performed by applying a gain value and a signal delay value, which are predetermined by a user, to each of the decoded multi-channel signals.

6. The method of claim 1, wherein the extracting of the power vector comprises:

calculating a power value by squaring each of the decoded multi-channel signals; and calculating the power vector of each of the plurality of multi-channel signals by multiplying an angle of the corresponding multi-channel speaker by the calculated power value.

7. The method of claim 1, wherein the extracting of the vector of the virtual sound source comprises:

adding a power vector value of a predetermined channel to a power vector value of a channel adjacent to the predetermined channel.

8. The method of claim 1, wherein the calculating of the normalized position values comprises:

calculating the vector of the dominant sound image by linearly combining the extracted vectors of the virtual sound sources; and calculating a normalized position value of each channel speaker by subtracting the position of the dominant sound image from an angle of the corresponding channel speaker.

9. The method of claim 1, wherein the distributing of the gain value comprises:

comparing a magnitude of the combined decoded multi-channel signal including all the decoded multi-channel signals with the magnitude of each individual multi-channel signal and adjusting the magnitude of each multi-channel signal according to a ratio of the magnitude of each individual multi-channel signal to the magnitude of the combined decoded multi-channel signal; and multiplying the adjusted magnitude of the multi-channel signal by the normalized position value.

10. An audio matrix decoding apparatus comprising:

a speaker component extraction unit to extract characteristics of a plurality of speaker signals and angles of each of a plurality of multi-channel speakers from arbitrary signals reproduced by the multi-channel speakers;

a passive matrix decoder unit to decode a stereo signal into multi-channel signals;

a signal correction unit to correct the multi-channel signals decoded by the passive matrix decoder unit based on the characteristics of each of the plurality of speaker signals extracted by the speaker component extraction unit;

a virtual sound source power vector estimation unit to extract a vector of a virtual sound source existing between a plurality of channels by combining power vectors of the multi-channel signals obtained by multiplying a magnitude of each of the multi-channel signals corrected by the signal correction unit by the angles of the corresponding multi-channel speakers;

a global vector extraction unit to extract a global vector indicating a position and magnitude of a dominant sound image by linearly combining the virtual sound source vectors estimated by the virtual sound source power vector estimation unit;

a channel selection unit to normalize a position of each of the multi-channel speakers with respect to the position of the dominant sound image estimated by the global vector extraction unit to obtain a normalized position value; and a channel power distribution unit to distribute the magnitude of each of the multi-channel signals according to a ratio of the magnitude of each individual multi-channel signal to a magnitude of a combined decoded multi-channel signal including all the decoded multi-channel signals.

11. The audio matrix decoding apparatus of claim 10, wherein the speaker component extraction unit comprises:

a signal generation portion to generate arbitrary signals;

a speaker portion to reproduce the arbitrary signals generated by the signal generation portion as sound;

a pair of microphone portions to convert the sound reproduced by the speaker portion into electrical signals; and a control portion to extract a gain value from levels of the electrical signals input from the microphone portions, extract a signal delay value from a point in time when the arbitrary signal is generated in the signal generation portion to a point in time when the electrical signals are output from the microphone portions, and extract an angle of the speaker portion by detecting a difference in paths taken by the arbitrary signals received by the microphone portions through the speaker portion.

12. The audio matrix decoding apparatus of claim 10, wherein the virtual sound source power vector estimation unit comprises:

a squaring unit to calculate a plurality of power values by squaring each of the decoded multi-channel signals;

a multiplication unit to extract the power vectors of each of the channels by multiplying the magnitude of each of the multi-channel signals calculated by the squaring unit by the angles of the corresponding multi-channel speakers; and an adder to add a vector of a selected channel signal extracted by the multiplication unit to the vector of a channel adjacent to the selected channel.

13. The audio matrix decoding apparatus of claim 10, wherein the channel selection unit comprises:

a subtracter to subtract the position of the dominant sound image extracted by the global vector extraction unit from an angle of a selected multi-channel speaker.

14. The audio matrix decoding apparatus of claim 10, wherein the channel power distribution unit comprises:

a multiplier to output a redistributed signal of each of the channels by multiplying a disposition function having the normalized position values as parameters by a gain adjusting function having the magnitude values of the decoded multi-channel signals as parameters.

15. The audio matrix decoding apparatus of claim 14, wherein the gain adjusting function increases the magnitude of a selected multi-channel signal if a ratio of the magnitude of the decoded selected multi-channel signal to the magnitude of the combined decoded multi-channel signal is equal to or greater than a predetermined level, and decreases the magnitude of the selected multi-channel signal if the ratio is less than the predetermined level.

16. The audio matrix decoding apparatus of claim 10, further comprising:

a channel extending unit to generate sound sources for a left back channel and a right back channel using a vector projection method and to readjust levels of power of a surround left channel signal and a surround right channel signal in consideration of a left back channel signal and a right back channel signal; and a channel power increasing unit to recalculate power of each of the multi-channel signals and to redistribute the recalculated power to each of the multi-channel signals.

17. An audio matrix decoding method comprising:

extracting characteristics of a plurality of speaker signals and angles of each of a plurality of multi-channel speakers from arbitrary signals reproduced by the multi-channel speakers;

decoding a stereo signal into a plurality of multi-channel signals;

correcting the decoded multi-channel signals based on the extracted characteristics of each of the plurality of speaker signals; and adjusting gain values of each of the decoded multi-channel signals by comparing magnitudes of the decoded multi-channel signals with a magnitude of a combined decoded multi-channel signal.

18. The method of claim 17, wherein the magnitude of the combined decoded multi-channel signal comprises the magnitudes of all the decoded multi-channel signals.

19. The method of claim 18, further comprising:

extracting a power vector of the decoded multi-channel signals by multiplying a magnitude of each of the decoded multi-channel signals by the angle of each multi-channel speaker and extracting a vector of a virtual sound source existing between a plurality of channels based on the power vector of each of the decoded multi-channel signals; and extracting a vector value of a dominant sound image by linearly combining the extracted vectors of the virtual sound sources and normalizing a position of each multi-channel speaker with respect to the vector value of the dominant sound image.

20. The method of claim 19, wherein the adjusting of the gain values comprises:

comparing the magnitude of the combined decoded multi-channel signal with the magnitude of each individual multi-channel signal and adjusting the magnitude of each multi-channel signal according to a ratio of the magnitude of each individual multi-channel signal to the magnitude of the combined decoded multi-channel signal; and multiplying the adjusted magnitude of the multi-channel signal by the normalized position value.

21. The method of claim 17, further comprising:

generating sound sources for a left back channel and a right back channel using a vector projection method;

readjusting levels of power of a surround left channel signal and a surround right channel signal in consideration of a left back channel signal and a right back channel signal;

recalculating power of each of the multi-channel signals; and redistributing the recalculated power to each of the multi-channel signals.

22. An audio matrix decoding apparatus comprising:

a speaker component extraction unit to extract characteristics of a plurality of speaker signals and angles of each of a plurality of multi-channel speakers from arbitrary signals reproduced by the multi-channel speakers;

a passive matrix decoder unit to decode a stereo signal into multi-channel signals;

a signal correction unit to correct the multi-channel signals decoded by the passive matrix decoder unit based on the characteristics of each of the plurality of speaker signals extracted by the speaker component extraction unit; and a channel power distribution unit to adjust gain values of each of the decoded multi-channel signals by comparing magnitudes of the decoded multi-channel signals with a magnitude of a combined decoded multi-channel signal.

23. An audio matrix decoding method of generating a multi-channel audio signal from a stereo-channel audio signal, the method comprising:

decoding the stereo-channel audio signal into a multi-channel signal;

extracting a power vector of each channel signal by multiplying a magnitude of each decoded channel signal by positions of a plurality of channel speakers;

extracting a vector of a virtual sound source existing between each channel by linearly combining power vector values of respective decoded channels;

extracting a vector value of a dominant sound image by linearly combining the vectors of the extracted virtual sound sources and normalizing the position of each channel speaker with respect to the vector value of the dominant sound image; and distributing a gain value to the position of each channel speaker by comparing the magnitude of an entire decoded channel signal with the magnitude of each channel signal.

24. The method of claim 23, wherein the extracting of the power vector comprises:

calculating power value by squaring each decoded channel signal; and calculating the power vector of each channel signal by multiplying a position vector of each channel speaker in the form of polar coordinates by the calculated power value.

25. The method of claim 23, wherein the extracting of the vector of the virtual sound source comprises adding the power vector value of a predetermined channel to the power vector value of a channel adjacent to the predetermined channel.

26. The method of claim 23, wherein the calculating of the normalized position values comprises:

calculating the vector of the dominant sound image by linearly combining the extracted vectors of the virtual sound sources; and calculating a normalized position value of each channel speaker by subtracting the position of the dominant sound image from the position of the channel speaker.

27. The method of claim 23, wherein the distributing of the gain value comprises:

comparing the magnitude of an entire decoded channel signal including all the decoded channel signals with the magnitude of each individual channel signal and adjusting the magnitude of each channel signal according to a ratio of the magnitude of each individual channel signal to the magnitude of the entire decoded channel signal; and multiplying the magnitude of the signal adjusted in each channel by the position value of each normalized channel.

28. An audio matrix decoding method, comprising:

passively decoding two channel signals into multi-channel signals; and adjusting characteristics of the multi-channel signals based on corresponding power vectors of the decoded multi-channel signals, positions of channel speakers corresponding to the multi-channel signals, and characteristics of virtual sound source vectors derived from the power vectors.

29. The audio matrix decoding method of claim 28, wherein the adjusting of the characteristics of the multi-channel signals comprises determining the power vectors of the decoded multi-channel signals by determining an energy component of each of the multi-channel signals that corresponds to an angular direction in which the corresponding channel speakers are arranged.

30. The audio matrix decoding method of claim 28, wherein the adjusting of the characteristics of the multi-channel signals comprises determining the virtual sound source vectors by combining the power vectors of adjacent pairs of the multi-channel signals.

31. The audio matrix decoding method of claim 28, wherein the adjusting of the characteristics of the multi-channel signals comprises determining a global power vector by combining each of the virtual sound source vectors and normalizing the positions of each of the channel speakers based on a comparison of the global power vector and the positions of each of the channel speakers.

32. The audio matrix decoding method of claim 31, wherein the adjusting of the characteristics of the multi-channel signals comprises determining the normalized positions of the channel speakers by subtracting an angular position of the global power vector from each of the positions of the channel speakers.

33. The audio matrix decoding method of claim 31, wherein the adjusting of the characteristics of the multi-channel signals further comprises:

comparing a magnitude of each of the individual multi-channel signals with a magnitude of a combination of the multi-channel signals to determine corresponding gain adjustment amounts; and adjusting the gains of the multi-channel signals by the corresponding gain adjustment amounts, and repositioning the gain adjusted multi-channel signals based on the normalized positions of the corresponding channel speakers.

34. An audio matrix decoding apparatus, comprising:

a passive decoding unit to decode two channel signals into multi-channel signals; and an active decoding unit to adjust characteristics of the multi-channel signals based on corresponding power vectors of the decoded multi-channel signals, positions of channel speakers corresponding to the multi-channel signals, and characteristics of virtual sound source vectors derived from the power vectors.

35. The audio matrix decoding apparatus of claim 34, wherein the active decoding unit determines the power vectors of the decoded multi-channel signals by determining an energy component of each of the multi-channel signals that corresponds to an angular direction in which the corresponding channel speakers are arranged.

36. The audio matrix decoding apparatus of claim 34, wherein the active decoding unit determines the virtual sound source vectors by combining the power vectors of adjacent pairs of the multi-channel signals.

37. The audio matrix decoding apparatus of claim 34, wherein the active decoding unit determines a global power vector by combining each of the virtual sound source vectors and normalizing the positions of each of the channel speakers based on a comparison of the global power vector and the positions of each of the channel speakers.

38. The audio matrix decoding apparatus of claim 37, wherein the active decoding unit determines the normalized positions of the channel speakers by subtracting an angular position of the global power vector from each of the positions of the channel speakers.

39. The audio matrix decoding apparatus of claim 37, wherein the active decoding unit compares a magnitude of each of the individual multi-channel signals with a magnitude of a combination of the multi-channel signals to determine corresponding gain adjustment amounts, adjusts the gains of the multi-channel signals by the corresponding gain adjustment amounts, and repositions the gain adjusted multi-channel signals based on the normalized positions of the corresponding channel speakers.

40. The audio matrix decoding apparatus of claim 34, wherein the active decoding unit extracts the power vectors of each channel signal by multiplying a magnitude of each decoded channel signal by positions of the channel speakers, extracts the virtual sound source vector existing between each channel by linearly combining power vector values of respective decoded channels, extracts a vector value of a dominant sound image by linearly combining the vectors of the extracted virtual sound sources and normalizing the position of each channel speaker with respect to the vector value of the dominant sound image, and distributes a gain value to each channel position by comparing the magnitude of an entire decoded channel signal with the magnitude of each channel signal.

41. An audio matrix decoding apparatus to generate a multi-channel audio signal from a stereo-channel audio signal, the apparatus comprising:

a passive decoder unit to decode the stereo-channel audio signal into a multi-channel signal through linear combination of channels; and an active decoder unit to extract a power vector of each channel signal by multiplying a magnitude of each channel signal decoded by the passive decoder unit by positions of a plurality of channel speakers, to extract a vector of a virtual sound source existing between each channel from power vector values of respective channels, to extract a global vector indicating a position and magnitude of a dominant sound image by linearly combining the virtual sound source vectors, to normalize the position of each channel speaker with respect to the position of the dominant sound image, and to distribute the magnitude of each channel signal according to a ratio of the magnitude of each individual channel signal to a magnitude of an entire decoded channel signal including all the decoded channel signals.

42. An audio matrix decoding apparatus to generate a multi-channel audio signal from a stereo-channel audio signal, the apparatus comprising:

a passive matrix decoder unit to decode the stereo-channel audio signal into a multi-channel signal through linear combination of channels;

a channel power vector extraction unit to extract a power vector of each channel signal by multiplying a magnitude of each channel signal decoded by the passive matrix decoder unit by positions of a plurality of channel speakers;

a virtual sound source power vector estimation unit to extract a vector of a virtual sound source existing between each channel from power vector values of respective channels extracted from the channel power vector extraction unit;

a global vector extraction unit to extract a global vector indicating a position and magnitude of a dominant sound image by linearly combining the virtual sound source vectors estimated by the virtual sound source power vector estimation unit;

a channel selection unit to normalize the position of each channel speaker with respect to the position of the dominant sound image estimated by the global vector extraction unit; and a channel power distribution unit to distribute the magnitude of each channel signal according to a ratio of the magnitude of each individual channel signal to a magnitude of an entire decoded channel signal including all the decoded channel signals.

43. The apparatus of claim 42, wherein the channel power vector extraction unit comprises:

a squaring unit to calculate each power value by squaring each decoded multi-channel signal; and a multiplication unit to calculate the power vector of each channel by multiplying the magnitude of each channel signal calculated by the squaring unit by the position value of the corresponding speaker in the form of polar coordinates.

44. The apparatus of claim 43, wherein the virtual sound source power vector estimation unit comprises an adder to add the vector value of a selected channel signal to the vector of a channel adjacent to the predetermined channel.

45. The apparatus of claim 43, wherein the channel selection unit comprises a subtracter to subtract the position of the dominant sound image extracted by the global vector extraction unit from the position value of a selected channel speaker.

46. The apparatus of claim 43, wherein the channel power distribution unit comprises a multiplier to output a redistributed signal of each channel by multiplying a disposition function having the position values of the normalized channels as parameters by a gain adjusting function having the magnitude values of the decoded channel signals as parameters.

47. The apparatus of claim 46, wherein the gain adjusting function increases the magnitude of a selected channel signal if the ratio of the magnitude of the decoded selected channel signal to the magnitude of the entire decoded channel signal is equal to or greater than a predetermine level, and decreases the magnitude of the selected channel signal if the ratio is less than the predetermined level.

* * * * *